US006001028A

United States Patent [19]

Tang et al.

[11] Patent Number: 6,001,028

[45] Date of Patent: Dec. 14, 1999

[54] DOUBLE-BALANCED GOLF CLUB HEAD

[76] Inventors: Huei-Hsien Tang, 10F-2, No. 45, Cheng Ta Rd., Ling Ya Dist., Kaohsiung, Taiwan; Chen-Feng Cheng, 14F., Bldg. C, No. 536, Feng Tung Rd., Feng Shan, Kaohsiung Hsien, Taiwan

[21] Appl. No.: 09/021,814

[22] Filed: Feb. 11, 1998

[51] Int. Cl.[6] ..... A63B 53/02

[52] U.S. Cl. ..... 473/313; 473/314

[58] Field of Search ..... 473/305, 313, 473/314, 345, 346, 340, 288, 293, 251, 226

[56] References Cited

U.S. PATENT DOCUMENTS 1,250,296 12/1917 Fitzjohn .
3,519,271 7/1970 Smith .
3,980,301 9/1976 Smith .
4,697,813 10/1987 Inoue .
5,160,141 11/1992 Crews .

*Primary Examiner*—Sebastiano Passaniti
*Attorney, Agent, or Firm*—Varndell & Varndell, PLLC

[57] ABSTRACT

A double-balanced golf club head including a club head body and a neck tube for securing a golf club shaft to the club head body, wherein the neck tube is peripherally attached to two opposite engagement grooves at two opposite sides of the club head body, having one end fastened to a blind hole at one end of the face panel of the club head body and an opposite end inserted through a through hole on an opposite end of the face panel of the club head body and then turned upwardly inwards and then upwardly backwards and terminating in a coupling end for connection to a golf club shaft.

3 Claims, 4 Drawing Sheets

DOUBLE-BALANCED GOLF CLUB HEAD

BACKGROUND OF THE INVENTION

The present invention relates to a golf club head, and more particularly to a double-balanced golf club head whose center of gravity can be conveniently positively adjusted after its fabrication.

It is well known that the location of the center of gravity of a golf club head greatly affects its performance. Therefore, a golf club head is generally equipped with a counterweight, that adjusts the center of gravity of the golf club head. However, after the counterweight has been installed and the fabrication of the golf club head has been done, the center of gravity of the golf club head cannot be further adjusted.

SUMMARY OF THE INVENTION

It is one object of the present invention to provide a double-balanced golf club head which can be positively accurately adjusted to change its center of gravity after its fabrication. It is another object of the present invention to provide a double-balanced golf club head which requires less time and less labor in adjusting the center of gravity. It is still another object of the present invention to provide a double-balanced golf club head which is easy and inexpensive to manufacture. According to the invention, the golf club head is comprised of a club head body, and a neck tube for securing the club head body to a golf club shaft. The neck tube has one end fastened to a blind hole at one end of the face panel of the club head body, and an opposite end inserted through a through hole on an opposite end of the face panel of the club head body and then turned upwardly inwards and then upwardly backwards and terminating in a coupling end for connection to a golf club shaft. Further, engagement grooves may be provided at two opposite sides of the club head body for engagement with a part of the periphery of the neck tube.

DETAILED DESCRIPTION OF THE PREFERRED EMBODIMENTS

Figure 1:
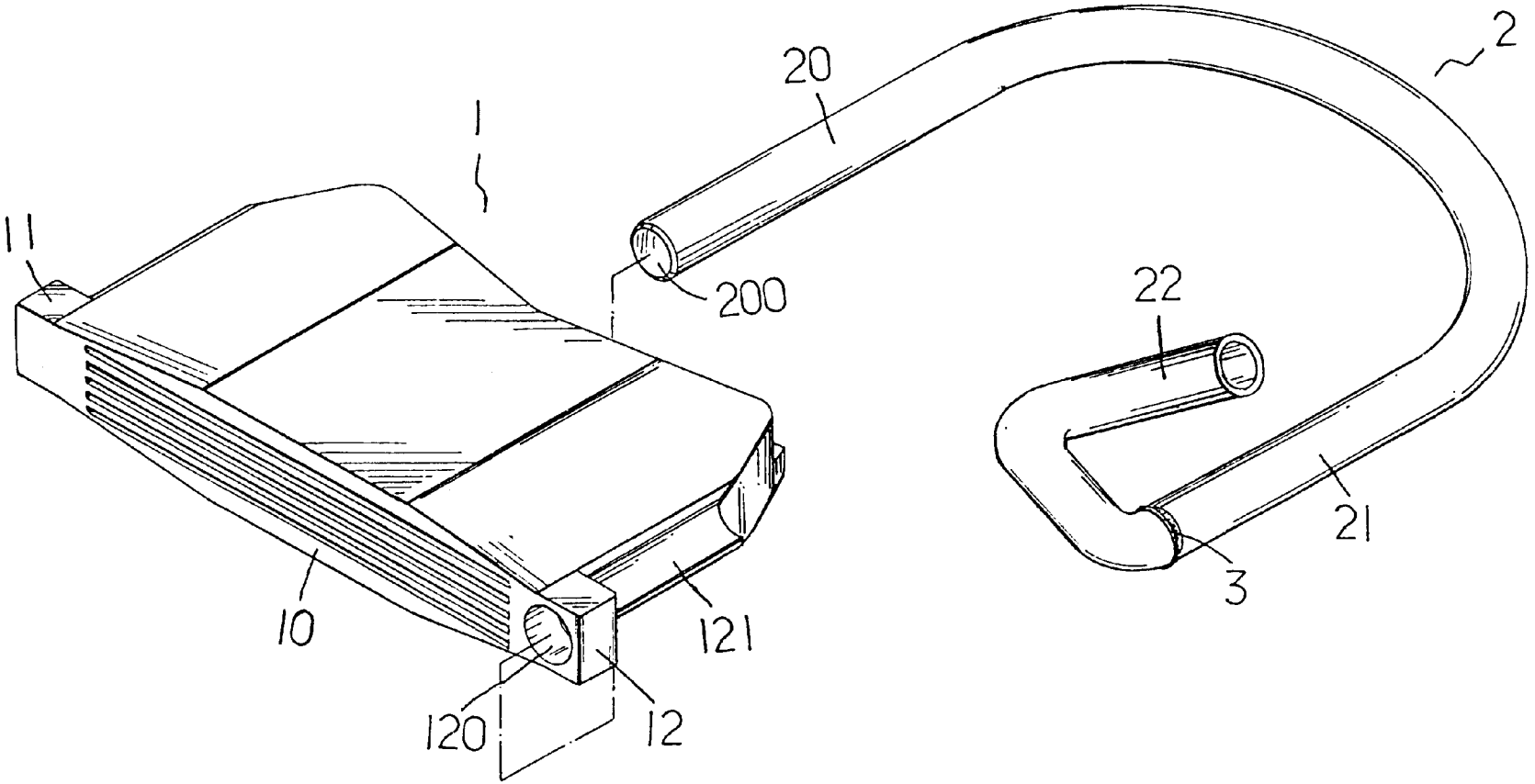
FIG. 1 is an exploded view of a double-balanced golf club head according to a first embodiment of the present invention.
Figure 3:
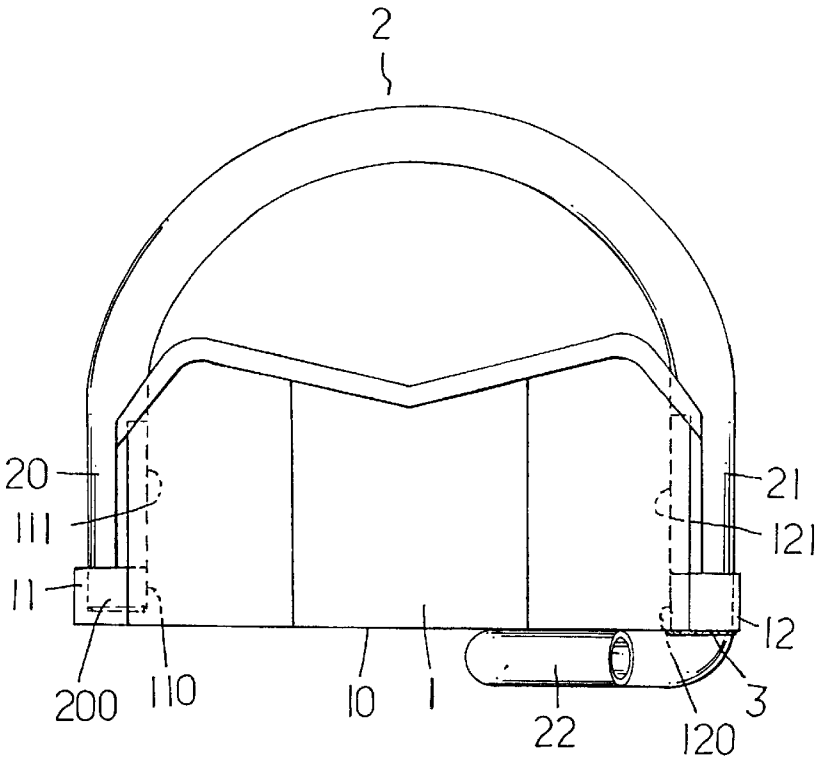
FIG. 3 is a top plain view of the first embodiment of the present invention.
Figure 2:
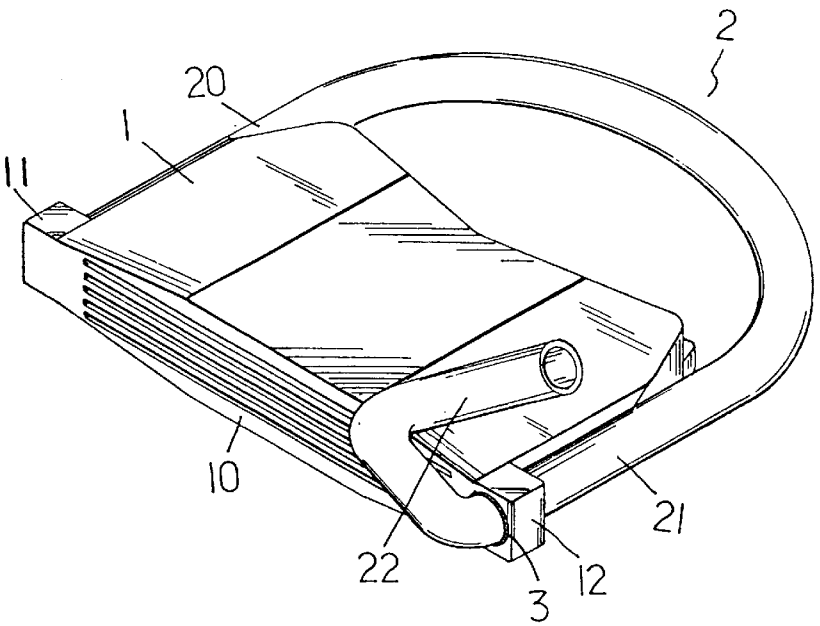
FIG. 2 is a perspective view of the first embodiment of the present invention.

Referring to FIGS. from 1 to 4, a double-balanced golf club head in accordance with the present invention is generally comprised of a club head body 1, and a neck tube 2 fastened to the body 1.

The club head body 1 comprises a face panel 10 for striking the ball, a first mounting block 11 and a second mounting block 12 integral with both ends of the face panel 10, a blind hole 110 at a back side of the first mounting block 11, a through hole 120 through the second mounting block 12, and two side grooves 111;121 respectively disposed at two opposite lateral sides thereof and backwardly extended from the mounting blocks 11;12.

Figure 4:
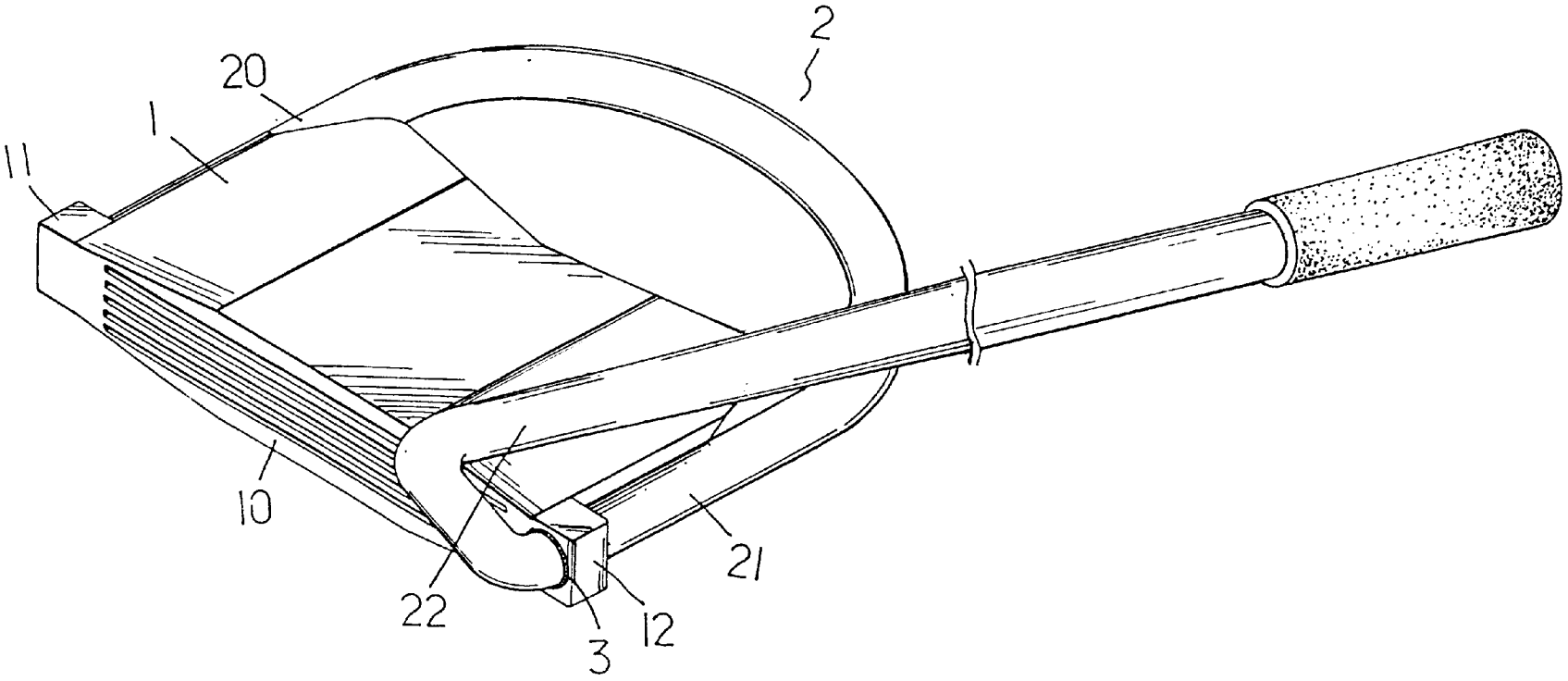
FIG. 4 is a perspective view of the present invention showing a golf club shaft fastened to the neck tube.

The neck tube 2 comprises a substantially U-shaped tube body 20. One end, namely, the first end 200 of the neck tube 2 is peripherally attached to one side groove 111 and then fastened to the blind hole 110 on the first mounting block 11 of the club head body 1. The other end, namely, the second end 21 of the neck tube 2 is smoothly curved from the first end 200 and extended over the rear side of the club head body 1, then peripherally attached to the other side groove 121, then inserted through the through hole 120 on the second mounting block 12 of the club head body 1, and then turned upwardly inwards and then upwardly backwards and terminating in a coupling end 22 to which a golf club shaft is fastened (see FIG. 4). Further, a wear-resisting ring 3 may be mounted around the second end 21 of the neck tube 2 and secured to the second mounting block 12 of the club head body 1. By changing the turning angle of the second end 21 of the neck tube 2, the center of gravity of the golf club head is relatively adjusted.

Figure 5:
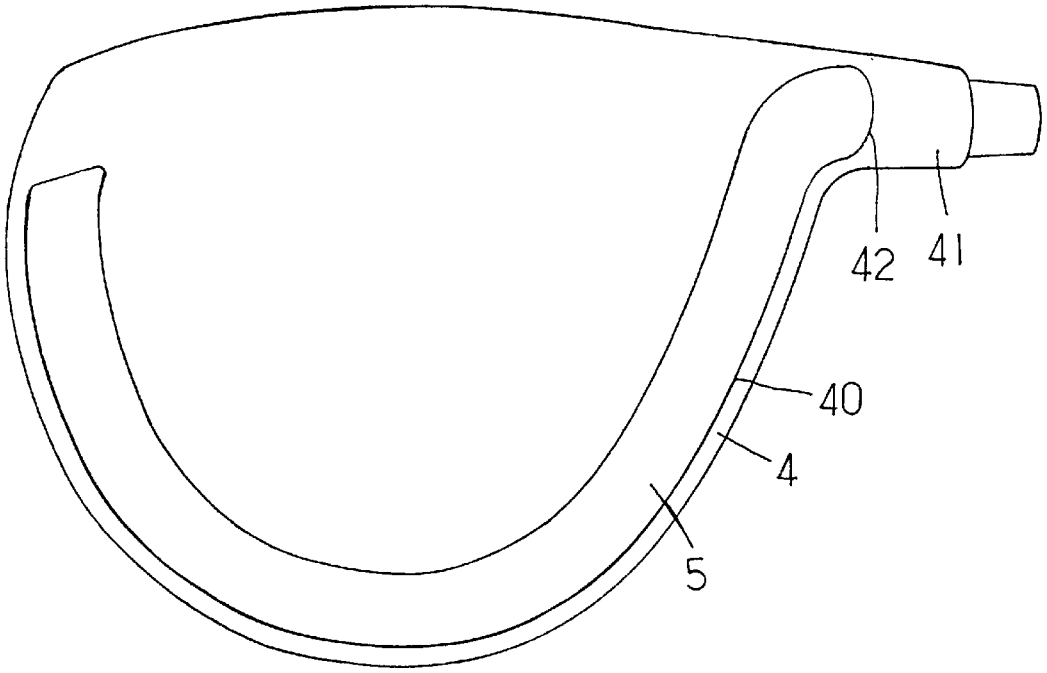
FIG. 5 illustrates a double-balanced golf club head according to a second embodiment of the present invention.
Figure 6:
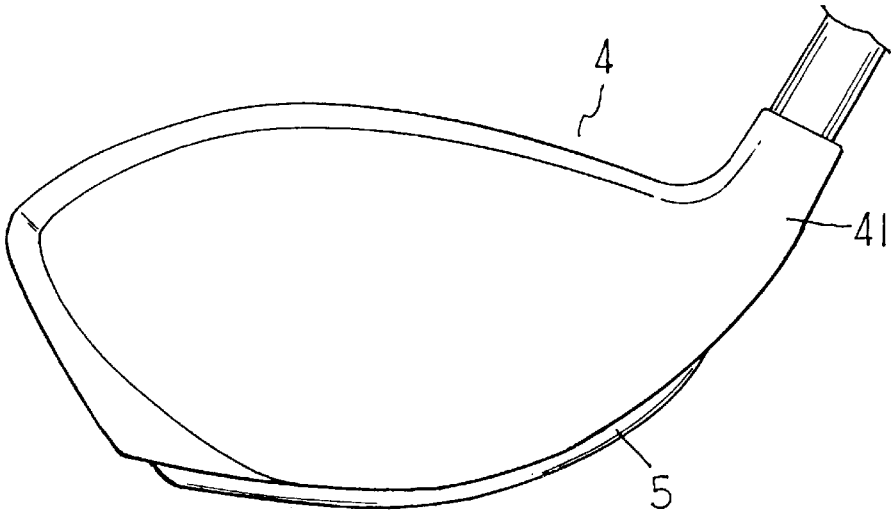
FIG. 6 is a front view of FIG. 5.

FIGS. 5 and 6 show an alternate form of the present invention, in which the club head body 4 has a smoothly curved engagement groove 40 at the bottom side, and a through hole 42 at a neck 41 thereof; a neck tube 5 is inserted through the through hole 42 and fastened to the engagement groove 40 at the bottom side of the club head body 4 for coupling to a golf club shaft.

What the invention claimed is:

1. A double-balanced golf club head comprising a club head body having a face panel, and a neck tube fixedly fastened to said club head body for securing said club head body to a golf club shaft, wherein said club head body comprises a first mounting block and a second mounting block integral with both ends of said face panel, a blind hole at said first mounting block, a through hole through said second mounting block, and at least one engagement groove on an outside portion of the club head body; said neck tube is peripherally attached to said at least one engagement groove on said club head body, having one end fastened to the blind hole on said first mounting block and an opposite end curved from said first end inserted through the through hole on said second mounting block for connection to a golf club shaft.

2. The double-balanced golf club head of claim 1, wherein said club head body comprises two engagement grooves at two opposite lateral sides thereof and respectively extending backwards from said first mounting block and said second mounting block for receiving a part of the periphery of said neck tube.

3. The double-balanced golf club head of claim 1, wherein said club head body comprises one engagement groove at a bottom side thereof for receiving a part of the periphery of said neck tube.

* * * * *